US010076818B2

(12) United States Patent
Feng et al.

(10) Patent No.: US 10,076,818 B2
(45) Date of Patent: Sep. 18, 2018

(54) POLISHING PAD AND METHOD FOR MAKING THE SAME

(71) Applicant: San Fang Chemical Industry Co., Ltd., Kaohsiung (TW)

(72) Inventors: Chung-Chih Feng, Kaohsiung (TW); I-Peng Yao, Kaohsiung (TW); Yung-Chang Hung, Kaohsiung (TW); Lyang-Gung Wang, Kaohsiung (TW)

(73) Assignee: San Fang Chemical Industry Co., Ltd., Kaohsiung (TW)

( * ) Notice: Subject to any disclaimer, the term of this patent is extended or adjusted under 35 U.S.C. 154(b) by 458 days.

(21) Appl. No.: 14/799,445

(22) Filed: Jul. 14, 2015

(65) Prior Publication Data

US 2016/0089764 A1 Mar. 31, 2016

(30) Foreign Application Priority Data

Sep. 25, 2014 (TW) ..... 103133338 A

(51) Int. Cl.
*B24D 11/00* (2006.01)
*B24B 37/26* (2012.01)

(52) U.S. Cl.
CPC ..... *B24B 37/26* (2013.01)

(58) Field of Classification Search
CPC ..... B24B 37/26; B24B 49/12; B24D 11/00
See application file for complete search history.

(56) References Cited

U.S. PATENT DOCUMENTS

| | | | | |
|---|---|---|---|---|
| 7,131,895 | B2 | 11/2006 | Elmufdi et al. | |
| 7,156,721 | B2 | 1/2007 | Palaparthi | |
| 7,435,161 | B2 | 10/2008 | Prasad et al. | |
| 2004/0192175 | A1 | 9/2004 | Nakano et al. | |
| 2005/0197050 | A1 | 9/2005 | Prasad et al. | |
| 2006/0135050 | A1* | 6/2006 | Petersen ..... | B24D 11/005 451/523 |

(Continued)

FOREIGN PATENT DOCUMENTS

| | | | |
|---|---|---|---|
| CN | 1494983 | A | 5/2004 |
| CN | 1954967 | A | 5/2007 |
| EP | 0878270 | A2 | 11/1998 |

(Continued)

OTHER PUBLICATIONS

Office action dated Jul. 14, 2016 by Taiwan Intellectual Property Office ofor the counterpart Taiwan Patent Application No. 103133338.

(Continued)

*Primary Examiner* — Pegah Parvini
(74) *Attorney, Agent, or Firm* — WPAT, P.C., Intellectual Property Attorneys; Anthony King

(57) ABSTRACT

The present invention relates to a polishing pad and a method for making the same. The polishing pad includes a base layer and a polishing layer. The base layer has a first surface and a plurality of first trenches. The first trench has an opening at the first surface. The polishing layer is located on the first surface of the base layer and fills the first trenches. The polishing layer has a plurality of second trenches, the positions of the second trenches correspond to those of the first trenches, and the depth of the second trenches is less than that of the first trenches.

11 Claims, 7 Drawing Sheets

(56) References Cited

U.S. PATENT DOCUMENTS

| | | | | |
|---|---|---|---|---|
| 2007/0093191 | A1* | 4/2007 | Wang | B24B 37/22 451/533 |
| 2010/0330879 | A1* | 12/2010 | Paik | B24B 37/205 451/6 |

FOREIGN PATENT DOCUMENTS

| | | | |
|---|---|---|---|
| EP | 0878270 | B1 | 7/2005 |
| JP | 2000-349053 | A | 12/2000 |
| JP | 5421635 | B2 | 2/2014 |
| JP | 5433384 | B2 | 3/2014 |
| TW | 513338 | | 12/2002 |
| TW | I322062 | | 3/2010 |
| TW | I322062 | B | 3/2010 |
| TW | 513338 | B | 12/2012 |

OTHER PUBLICATIONS

Search report dated Jul. 14, 2016 by Taiwan Intellectual Property Office ofor the counterpart Taiwan Patent Application No. 103133338.

English translation of the Search report dated Jul. 14, 2016 by Taiwan Intellectual Property Office ofor the counterpart Taiwan Patent Application No. 103133338.

English abstract translation of TW I322062.

English abstract translation of TW 513338.

Abstract of EP 0878270 A2.

Office Action and search report dated Aug. 31, 2017 for the counterpart China Patent Application No. 201510028976.4.

English translation of the search report dated Aug. 31, 2017 for the counterpart China Patent Application No. 201510028976.4.

English abstract of Taiwan Publication No. 513338B.

English abstract of Taiwan Publication No. I322062B.

English abstract of European Patent Publication No. 0878270B1.

English abstract of Japan Publication No. 2000-349053A.

English abstract of Japan Publication No. 5421635B2.

English abstract of Japan Publication No. 5433384B2.

English abstract of China Publication No. 1494983A.

English abstract of China Publication No. 1954967A.

* cited by examiner

POLISHING PAD AND METHOD FOR MAKING THE SAME

BACKGROUND OF THE INVENTION

1. Field of the Invention

The present invention relates to a polishing pad and a method for making the same, and more particularly to a polishing pad having trenches and a method for making the same.

2. Description of the Related Art

FIG. 1 and FIG. 2 are schematic views of a method for making a conventional polishing pad. Referring to FIG. 1, polyurethane resin is formed on an upper surface 101 of a non-woven fabric 10. Next, the non-woven fabric 10 and the polyurethane resin are immersed in a curing liquid, to cure the polyurethane resin, thereby forming a grinding layer 12, where the grinding layer 12 has an upper surface 121 and a plurality of cells 14.

Next, a plurality of trenches 13 is formed on the upper surface 121 of the grinding layer 12 through laser or cutting. Subsequently, the upper surface 121 of the grinding layer 12 is ground with sandpaper, so as to produce a sense of fluff, and each of the cells 14 has an opening on the upper surface 121 of the grinding layer 12. Finally, a back adhesive layer 16 is bonded to a lower surface 102 of the non-woven fabric 10, to make a polishing pad 1.

The conventional polishing pad 1 has the following disadvantages. Firstly, the trenches 13 are formed through laser or cutting, thus, fringes 17 may be formed on sidewalls of the trenches 13 in this manner, and debris 18 remains on bottom walls of the trenches 13. When the polishing pad 1 is applied in a polishing process, the fringes 17 and the debris 18 may directly contact a workpiece to be polished to scratch the workpiece to be polished, resulting in scratch defects. Secondly, the space of a lower part of each cell 14 is larger than the space of an upper part of the cell 14. When the trenches 13 are formed, the upper parts of the cells 14 are removed, but the lower parts of the cells 14 remain, and thus a large amount of solid portions of the grinding layer 12 is removed, resulting in that the structural strength of the grinding layer 12 declines and a peeling damage occurs earlier, thereby reducing the service life of the polishing pad 1. Thirdly, the non-woven fabric 10 becomes brittle due to variation of fabric density distribution and permeation of the slurry, which easily results in that a part of the back adhesive layer 16 remains on a disc surface of a grinding device when the polishing pad 1 is replaced.

Therefore, it is necessary to provide an innovative and progressive polishing pad and a method for making the same, so as to solve the above problems.

SUMMARY OF THE INVENTION

The present invention provides a polishing pad. The polishing pad comprises a base layer and a polishing layer. The base layer has a first surface, a second surface, and a plurality of first trenches. Each of the first trenches has an opening at the first surface. The polishing layer is located on the first surface of the base layer and fills the first trenches. The polishing layer has a plurality of second trenches. The positions of the second trenches correspond to those of the first trenches. The depth of the second trenches is less than that of the first trenches.

The present invention further provides a method for making a polishing pad. The method comprises the steps of: (a) providing a base layer, the base layer having a first surface and a second surface; (b) forming a plurality of first trenches on the first surface of the base layer; (c) covering the first surface of the base layer with a second polymer resin, wherein the second polymer resin fills the first trenches to have a plurality of second trenches, the positions of the second trenches correspond to those of the first trenches, and the depth of the second trenches is less than that of the first trenches; and (d) curing the second polymer resin, so as to form a polishing layer.

Thereby, the polishing layer completely covers the fringes and the debris in the first trenches, and the second trenches do not have any fringe or debris, which thus can avoid that, during a polishing process, a workpiece to be polished is scratched to result in scratch defects. In addition, the second trenches of the polishing layer are formed indirectly, which has no direct structural damage to the polishing layer, and thus the structural strength of the polishing layer and the service life of the polishing pad are not affected.

BRIEF DESCRIPTION OF THE DRAWINGS

The invention will be described according to the appended drawings in which.

PREFERRED EMBODIMENT OF THE INVENTION

The present invention provides a polishing pad. The polishing pad is used in a chemical mechanical polishing (CMP) process to polish or grind a workpiece to be polished. The workpiece to be polished is an object such as a semiconductor, a storage medium substrate, an integrated circuit (IC), an LCD flat glass, an optical glass, or a photoelectric panel.

Figure 1:
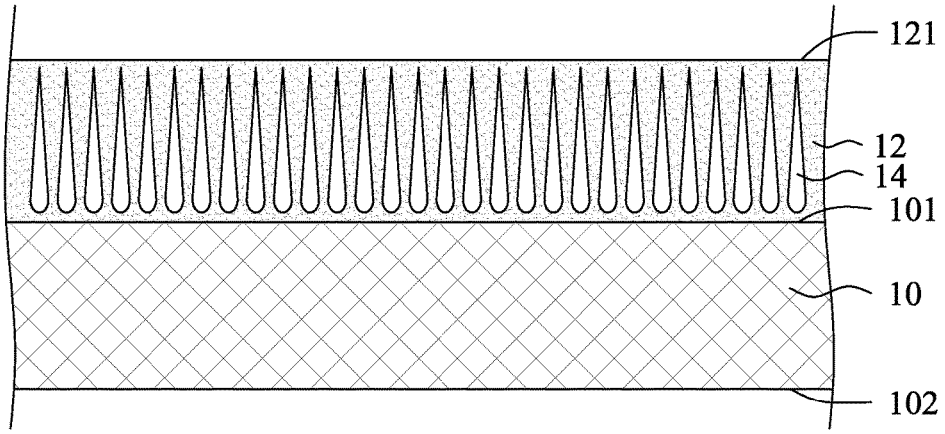
FIG. 1 (Prior Art)
FIG. 1 and FIG. 2 are schematic views of a method for making a conventional polishing pad.
Figure 2:
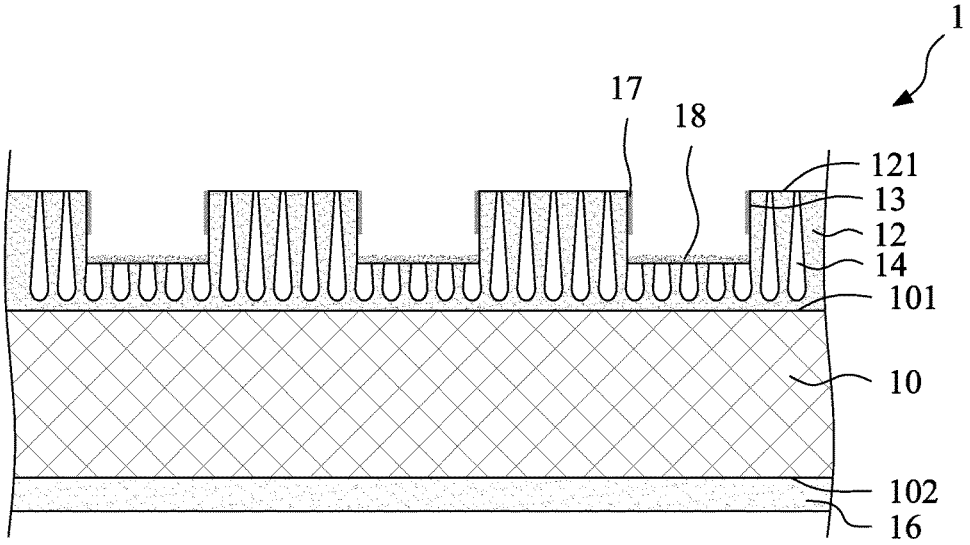
FIG. 2 (Prior Art)
Figure 3:
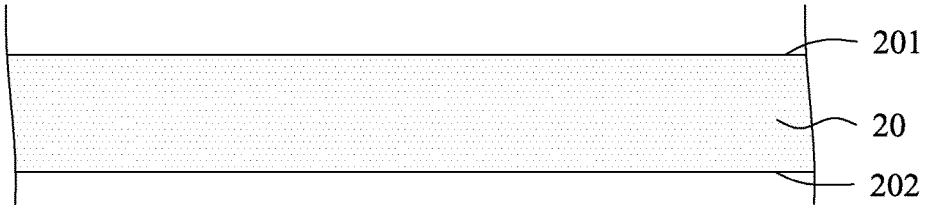
FIG. 3 to FIG. 8 are schematic views of process steps of a method for making a polishing pad according to an embodiment of the present invention.

FIG. 3 to FIG. 8 are schematic views of process steps of a method for making a polishing pad according to an embodiment of the present invention. Referring to FIG. 3, a base layer 20 is provided. The base layer 20 has a first surface 201 and a second surface 202. The base layer 20 is formed by curing a first polymer resin, and the first polymer resin is made of a material selected from the group consisting of polyethylene terephthalate resin, oriented polypropylene resin, polycarbonate resin, polyamide resin, epoxy resin, phenol resin, polyurethane resin, vinylbenzene resin, and acrylic resin. In this embodiment, the first polymer resin is made of polyethylene terephthalate resin.

The base layer 20 has a thickness in a range between 0.01 mm and 0.20 mm; the base layer 20 has a surface roughness (Ra) in a range between 1 μm and 30 μm; the base layer 20 has a tensile strength in a range between 30 $N/mm^2$ and 300

N/mm$^2$; the base layer 20 has a shrinkage ratio (150° C./15 mim) in a range between 0% and 5%; and the base layer 20 has a hardness in a range between 75 shore A and 95 shore A. In this embodiment, the thickness of the base layer 20 is 0.188 mm; the surface roughness (Ra) of the base layer 20 is less than 3 μm; the tensile strength of the base layer 20 is 179 N/mm$^2$; the shrinkage ratio (150° C./15 mim) of the base layer 20 is 0.97%; and the hardness of the base layer 20 is 86.5 shore A.

Figure 4:
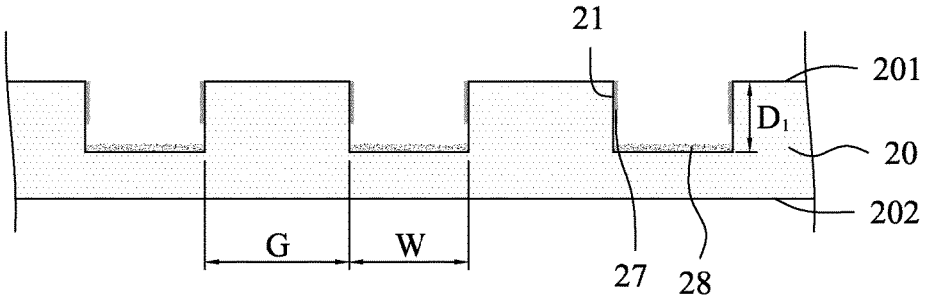

Referring to FIG. 4, a plurality of first trenches 21 is formed on the first surface 201 of the base layer 20 through laser, hot pressing, cutting or a high frequency wave. Meanwhile, fringes 27 may be formed on sidewalls of the first trenches 21, and debris 28 remains on bottom walls of the first trenches 21. Each of the first trenches 21 has an opening on the first surface 201, and has a first depth $D_1$, a first width W, and a first gap G. The first depth $D_1$ is between 100 μm and 200 μm, the first width W is between 30 μm and 2500 μm, and the first gap G is between 50 μm and 3500 μm. In this embodiment, the first depth $D_1$ is 100 μm, the first width W is 60 μm, and the first gap G is 300 μm.

Figure 5:
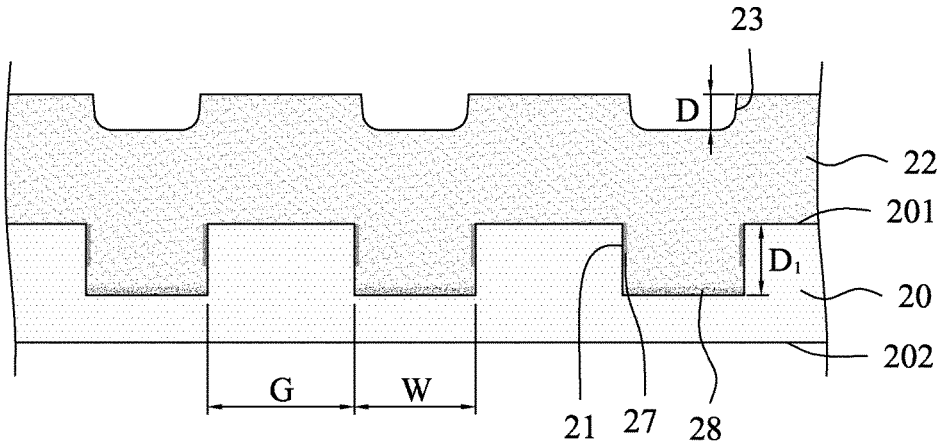

Referring to FIG. 5, the first surface 201 of the base layer 20 is covered with a second polymer resin 22. The second polymer resin 22 is made of a material selected from the group consisting of polyethylene terephthalate resin, oriented polypropylene resin, polycarbonate resin, polyamide resin, epoxy resin, phenol resin, polyurethane resin, vinylbenzene resin, and acrylic resin. In this embodiment, the second polymer resin 22 is made of polyurethane resin.

The second polymer resin 22 has viscosity in a range between 1000 cps and 6000 cps, and has a thickness in a range between 80 μm and 350 μm. In this embodiment, the viscosity of the second polymer resin 22 is 2500 cps, and the thickness is 120 μm.

The second polymer resin 22 fills the first trenches 21 to have a plurality of second trenches 23. That is, the second polymer resin 22 permeates into the first trenches 21 to form the second trenches 23 on its surface. Meanwhile, the second polymer resin 22 completely covers the fringes 27 and the debris 28, and there is no fringe or debris in the second trenches 23. The positions of the second trenches 23 correspond to those of the first trenches 21 (the position of one of the second trenches 23 corresponds to respective one of the first trenches 21), and each of the second trenches 23 has an opening on an upper surface of the second polymer resin 22. The second trench 23 has a depth D, and the depth D of the second trench 23 is less than the first depth $D_1$ of the first trench 21. In this embodiment, D is about 0.3 $D_1$ to 0.6 $D_1$, that is, D is between about 30 μm and about 60 μm.

Figure 6:
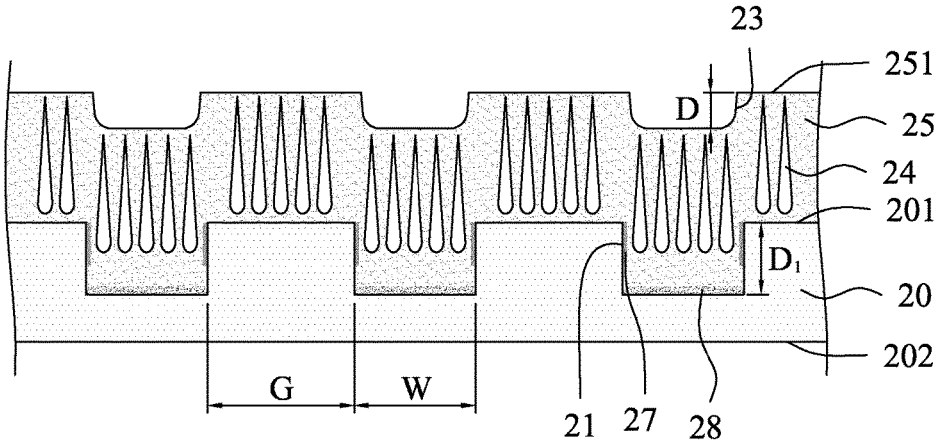

Referring to FIG. 6, the second polymer resin 22 is cured, to form a polishing layer 25. In this embodiment, the base layer 20 and the second polymer resin 22 are immersed in a curing liquid, to cure the second polymer resin 22, thereby forming the polishing layer 25, where the polishing layer 25 has an upper surface 251 and a plurality of cells 24. In this embodiment, the curing liquid includes dimethylformamide (DMF) and water, and concentration thereof is 5%.

Next, hot water at 80° C. is used to wash away the DMF. Subsequently, a drying process is performed for 10 minutes under an environment of 130° C., to obtain a semi-finished product with unexposed surface openings.

Figure 7:
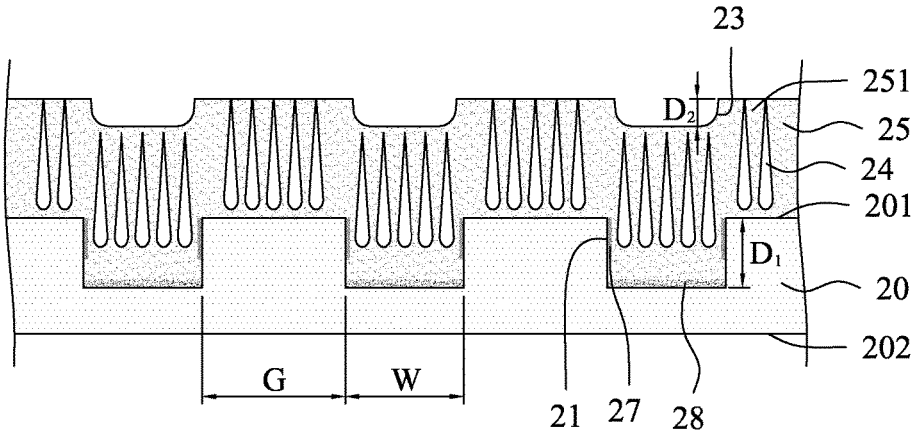

Referring to FIG. 7, the upper surface 251 of the polishing layer 25 is ground with sandpaper, to produce a sense of fluff, and the cell 24 has an opening on the upper surface 251 of the polishing layer 25. Meanwhile, the second trench 23 has a second depth $D_2$, and the second depth $D_2$ of the second trench 23 is less than the first depth $D_1$ of the first trenches 21. In this embodiment, $D_2$=0.3 $D_1$ to 0.6 $D_1$, that is, $D_2$ is between 30 μm and 60 μm.

Figure 8:
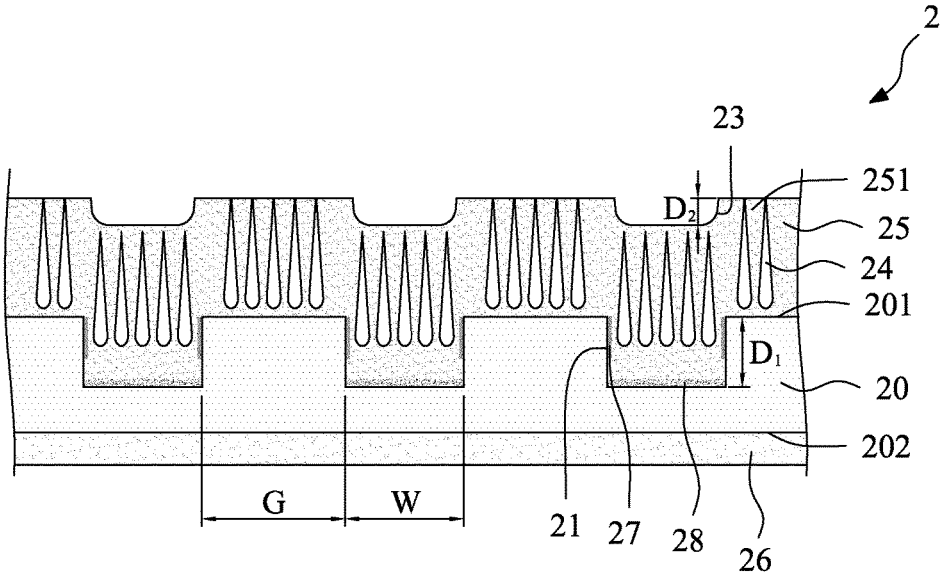

Referring to FIG. 8, a back adhesive layer 26 is bonded to the second surface 202 of the base layer 20, to make a polishing pad 2.

Figure 9:
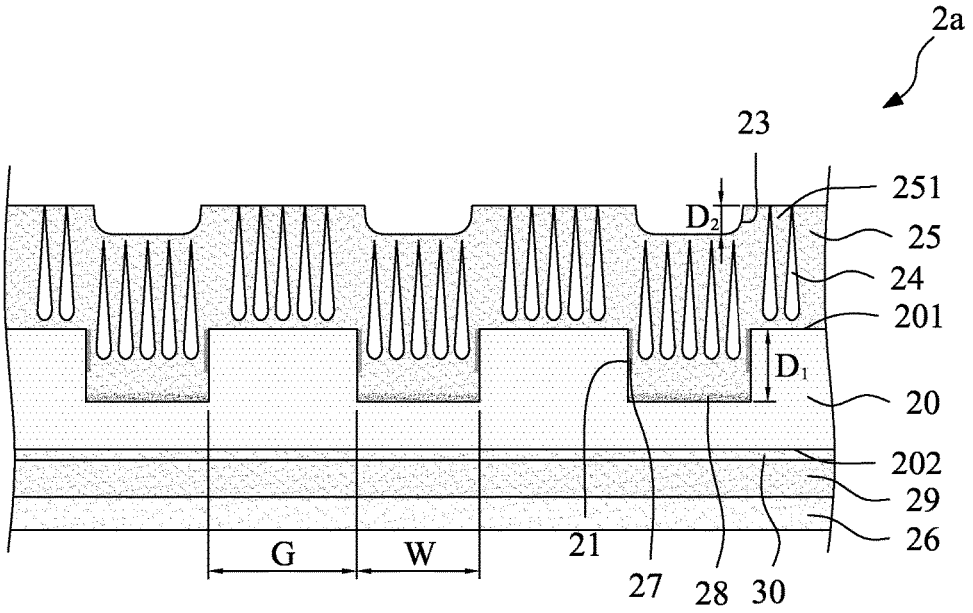
FIG. 9 is a schematic view of process step of a method for making a polishing pad according to another embodiment of the present invention.

FIG. 9 is a schematic view of process step of a method for making a polishing pad according to another embodiment of the present invention. The "initial" process steps of the method of this embodiment are the same as the process steps shown in FIGS. 3 to 7. The method of this embodiment is subsequent to the process step of FIG. 7. Referring to FIG. 9, a buffer layer 29 is bonded to the second surface 202 of the base layer 20 by using an adhesive layer 30. The buffer layer 29 is formed by foaming a third polymer resin, and the third polymer resin is made of a material selected from the group consisting of polyethylene terephthalate resin, polycarbonate resin, and polyurethane resin. In this embodiment, the third polymer resin is made of polyurethane resin. The density of the buffer layer 29 is in a range between 0.100 g/cm$^3$ and 0.350 g/cm$^3$, and the density of the polishing layer 25 is in a range between 0.100 g/cm$^3$ and 0.350 g/cm$^3$. Generally, the density of the buffer layer 29 is less than that of the polishing layer 25.

Then, the back adhesive layer 26 is bonded to the buffer layer 29, so as to obtain a polishing pad 2*a*. In addition, in other embodiment, the back adhesive layer 26 is bonded to the buffer layer 29 firstly, then, the buffer layer 29 (together with the back adhesive layer 26) is bonded to the second surface 202 of the base layer 20 through the adhesive layer 30.

Referring to FIG. 8 again, FIG. 8 is a schematic cross-sectional view of a polishing pad according to an embodiment of the present invention. The polishing pad 2 comprises a base layer 20, a polishing layer 25, and a back adhesive layer 26. The base layer 20 has a first surface 201, a second surface 202, and a plurality of first trenches 21. The first trench 21 has an opening on the first surface 201. The base layer 20 is formed by curing a first polymer resin, and the first polymer resin is made of a material selected from the group consisting of polyethylene terephthalate resin, oriented polypropylene resin, polycarbonate resin, polyamide resin, epoxy resin, phenol resin, polyurethane resin, vinylbenzene resin, and acrylic resin. In this embodiment, the first polymer resin is made of polyethylene terephthalate resin.

The base layer 20 has a thickness in a range between 0.01 mm and 0.20 mm; the base layer 20 has a surface roughness (Ra) in a range between 1 μm and 30 μm; the base layer 20 has a tensile strength in a range between 30 N/mm$^2$ and 300 N/mm$^2$; the base layer 20 has a shrinkage ratio (150° C./15 mim) in a range between 0% and 5%; and the base layer 20 has a hardness in a range between 75 shore A and 95 shore A. In this embodiment, the thickness of the base layer 20 is 0.188 mm; the surface roughness (Ra) of the base layer 20 is less than 3 μm; the tensile strength of the base layer 20 is 179 N/mm$^2$; the shrinkage ratio (150° C./15 mim) of the base layer 20 is 0.97%; and the hardness of the base layer 20 is 86.5 shore A.

Each of the first trenches 21 has an opening on the first surface 201, and has a first depth $D_1$, a first width W, and a first gap G therebetween. The first depth $D_1$ is between 100 μm and 200 μm, the first width W is between 30 μm and 2500 μm, and the first gap G is between 50 μm and 3500 μm. In this embodiment, the first depth $D_1$ is 100 μm, the first width W is 60 μm, and the first gap G is 500 μm.

The polishing layer 25 is located on the first surface 201 of the base layer 20, and fills the first trenches 21. The polishing layer 25 completely covers the fringes 27 and the debris 28 in the first trenches 21. The polishing layer 25 is formed by curing a second polymer resin, and the second polymer resin is made of a material selected from the group consisting of polyethylene terephthalate resin, oriented polypropylene resin, polycarbonate resin, polyamide resin, epoxy resin, phenol resin, polyurethane resin, vinylbenzene resin, and acrylic resin. In this embodiment, the second polymer resin is made of polyurethane resin.

The second polymer resin has viscosity in a range between 1000 cps and 6000 cps, and has a thickness in a range between 80 μm and 350 μm. In this embodiment, the viscosity of the second polymer resin is 2500 cps, and the thickness is 120 μm.

The polishing layer 25 has an upper surface 251, a plurality of second trenches 23, and a plurality of cells 24. The positions of the second trenches 23 correspond to those of the first trenches 21 (the position of one of the second trenches 23 corresponds to respective one of the first trenches 21), and the second trench 23 has an opening on the upper surface 251 of the polishing layer 25. There is no fringe or debris in the second trenches 23. The second trench 23 has a second depth $D_2$, and the second depth $D_2$ of the second trench is less than the first depth $D_1$ of the first trench 21. In this embodiment, $D_2$=0.3 $D_1$ to 0.6 $D_1$, that is, $D_2$ is between 30 μm and 60 μm.

The back adhesive layer 26 is located on the second surface 202 of the base layer 20 and is used to adhere to a machine table.

This embodiment has the following advantages. Firstly, in this embodiment, the second trenches 23 of the polishing layer 25 are formed indirectly; therefore, the polishing layer 25 completely covers the fringes 27 and the debris 28 in the first trenches 21, and there is no fringe or debris in the second trenches 23, which thus can avoid that, during a polishing process, a workpiece to be polished is scratched to result in scratch defects. Secondly, in this embodiment, the second trenches 23 of the polishing layer 25 are formed indirectly, which has no direct structural damage to the polishing layer 25 (the structure of the cells 24 is intact), and thus, the structural strength of the polishing layer 25 and the service life of the polishing pad 2 are not affected. Thirdly, in this embodiment, the base layer 20 may be made of a polymer resin, and therefore, the base layer 20 is less likely to become brittle because of permeation of the slurry, and is less likely to have a problem of a residual adhesive of the back adhesive layer.

Referring to FIG. 9 again, FIG. 9 is a schematic cross-sectional view of a polishing pad according to another embodiment of the present invention. The polishing pad 2*a* of this embodiment is similar to the polishing pad 2 of FIG. 8, wherein the same elements are designated with the same reference numerals, and the difference therebetween is described as follows. In this embodiment, polishing pad 2*a* further comprises an adhesive layer 30 and a buffer layer 29. The buffer layer 29 is located between the second surface 202 of the base layer 20 and the back adhesive layer 26. The buffer layer 29 is formed by foaming a third polymer resin, and the third polymer resin being made of a material selected from the group consisting of polyethylene terephthalate resin, polycarbonate resin, and polyurethane resin. In this embodiment, the third polymer resin is made of polyurethane resin. The density of the buffer layer 29 is in a range between 0.100 g/cm$^3$ and 0.350 g/cm$^3$, and the density of the polishing layer 25 is in a range between 0.100 g/cm$^3$ and 0.350 g/cm$^3$. Generally, the density of the buffer layer 29 is less than that of the polishing layer 25. The back adhesive layer 26 is bonded to the lower surface of the buffer layer 29, and the upper surface of the buffer layer 29 is bonded to the second surface 202 of the base layer 20 through the adhesive layer 30.

Figure 10:
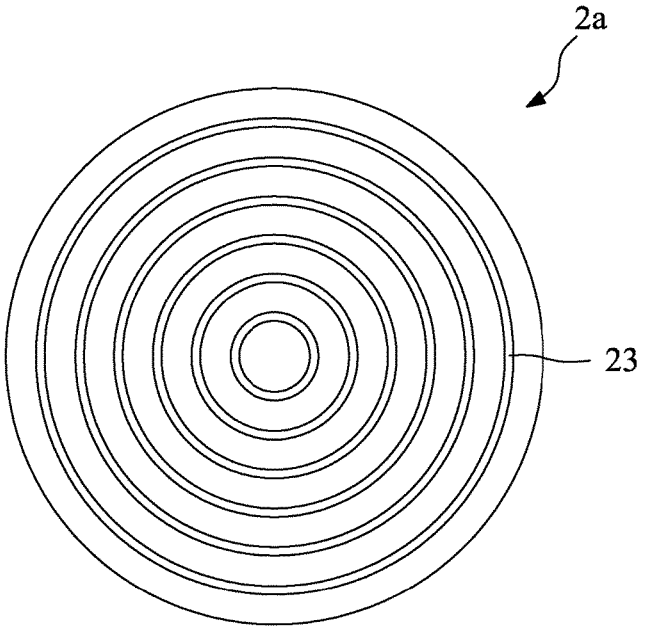
FIG. 10 is a schematic top view of the polishing pad according to an embodiment of the present invention.

FIG. 10 is a schematic top view of the polishing pad according to an embodiment of the present invention. In the polishing pad 2 of this embodiment, the second trenches 23 are a plurality of concentric circular trenches with different radiuses.

Figure 11:
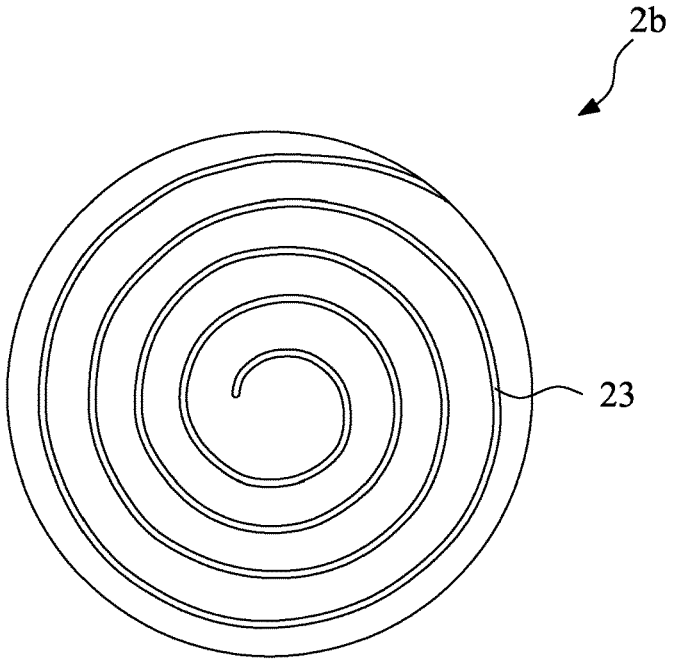
FIG. 11 is a schematic top view of the polishing pad according to another embodiment of the present invention.

FIG. 11 is a schematic top view of the polishing pad according to another embodiment of the present invention. In the polishing pad 2*b* of this embodiment, the second trench 23 is a spiral trench.

Figure 12:
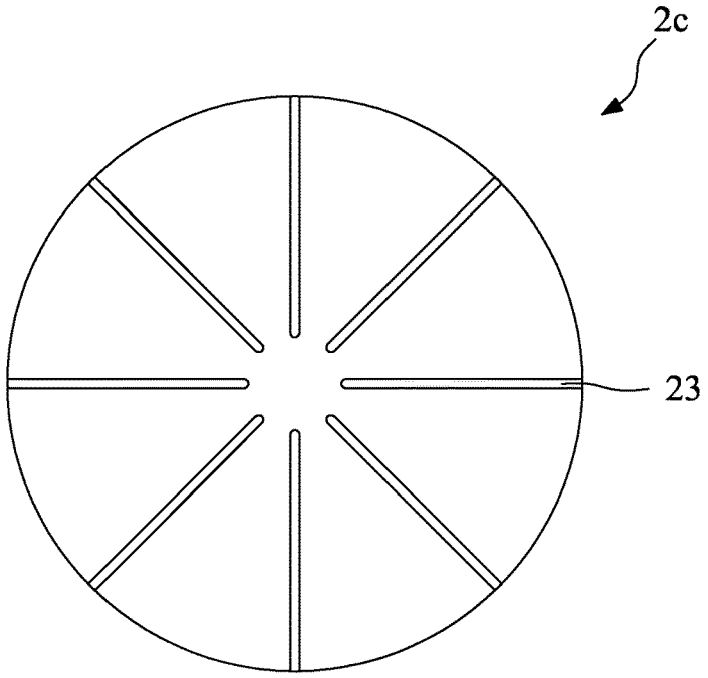
FIG. 12 is a schematic top view of the polishing pad according to another embodiment of the present invention.

FIG. 12 is a schematic top view of the polishing pad according to another embodiment of the present invention. In the polishing pad 2*c* of this embodiment, the second trenches 23 are a plurality of radial trenches.

Figure 13:
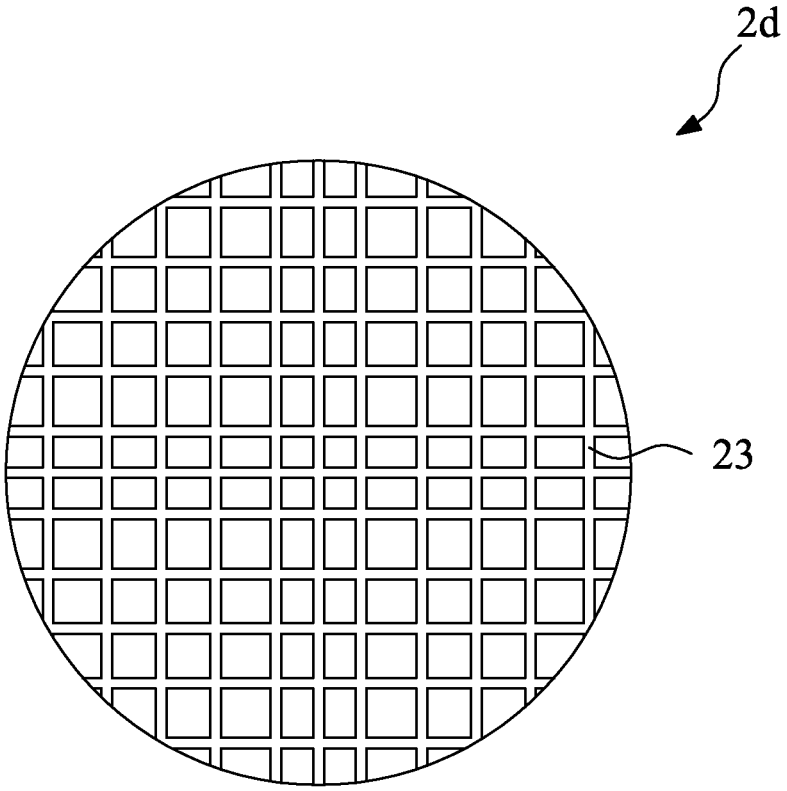
FIG. 13 is a schematic top view of the polishing pad according to another embodiment of the present invention.

FIG. 13 is a schematic top view of the polishing pad according to another embodiment of the present invention. In the polishing pad 2*d* of this embodiment, the second trenches 23 are a plurality of trenches that perpendicularly intersect with each other.

The above embodiments only describe the principle and the efficacies of the present invention, and are not used to limit the present invention. Therefore, modifications and variations of the embodiments made by persons skilled in the art do not depart from the spirit of the invention. The scope of the present invention should fall within the scope as defined in the appended claims.

What is claimed is:

1. A polishing pad, comprising:

a base layer having a first surface, a second surface, and a plurality of first trenches, wherein the first trench has an opening at the first surface; and a polishing layer located on the first surface of the base layer and filling the first trenches, the polishing layer having a plurality of second trenches, the positions of the second trenches corresponding to those of the first trenches, and the depth of the second trenches being less than that of the first trenches.

2. The polishing pad according to claim 1, wherein the base layer is formed by curing a first polymer resin, the first polymer resin is made of a material selected from the group consisting of polyethylene terephthalate resin, oriented polypropylene resin, polycarbonate resin, polyamide resin, epoxy resin, phenol resin, polyurethane resin, vinylbenzene resin, and acrylic resin; the polishing layer is formed by curing a second polymer resin, and the second polymer resin is made of a material selected from the group consisting of polyethylene terephthalate resin, oriented polypropylene resin, polycarbonate resin, polyamide resin, epoxy resin, phenol resin, polyurethane resin, vinylbenzene resin, and acrylic resin.

3. The polishing pad according to claim 1, wherein the first trench has a depth of $D_1$, the second trench has a depth of $D_2$, and $D_2$=0.3 $D_1$ to 0.6 $D_1$.

4. The polishing pad according to claim 1, further comprising a back adhesive layer located on the second surface of the base layer and used to adhere to a machine table.

5. The polishing pad according to claim 4, further comprising a buffer layer located between the second surface of the base layer and the back adhesive layer, the buffer layer being formed by foaming a third polymer resin, and the third polymer resin being made of a material selected from the group consisting of polyethylene terephthalate resin, polycarbonate resin, and polyurethane resin.

6. A method for making a polishing pad, comprising the steps of:

(a) providing a base layer, the base layer having a first surface and a second surface;

(b) forming a plurality of first trenches on the first surface of the base layer;

(c) covering the first surface of the base layer with a second polymer resin, wherein the second polymer resin fills the first trenches to have a plurality of second trenches, the positions of the second trenches correspond to those of the first trenches, and the depth of the second trenches is less than that of the first trenches; and (d) curing the second polymer resin, so as to form a polishing layer.

7. The method according to claim 6, wherein after the step (d), the method further comprises a step of bonding a back adhesive layer to the second surface of the base layer.

8. The method according to claim 6, wherein after the step (d), the method further comprises:

(d1) bonding a buffer layer to the second surface of the base layer; and (d2) bonding a back adhesive layer to the buffer layer.

9. The method according to claim 6, wherein after the step (d), the method further comprises:

(d1) bonding a back adhesive layer to a buffer layer; and (d2) bonding the buffer layer to the second surface of the base layer.

10. The method according to claim 6, wherein after the step (d), the method further comprises a step of grinding a surface of the polishing layer.

11. The method according to claim 6, wherein in the step (a), the base layer is formed by curing a first polymer resin, the first polymer resin is made of a material selected from the group consisting of polyethylene terephthalate resin, oriented polypropylene resin, polycarbonate resin, polyamide resin, epoxy resin, phenol resin, polyurethane resin, vinylbenzene resin, and acrylic resin, and in the step (c), the second polymer resin is made of a material selected from the group consisting of polyethylene terephthalate resin, oriented polypropylene resin, polycarbonate resin, polyamide resin, epoxy resin, phenol resin, polyurethane resin, vinylbenzene resin, and acrylic resin.

* * * * *